US006550068B1

(12) United States Patent
Materon

(10) Patent No.: US 6,550,068 B1
(45) Date of Patent: Apr. 22, 2003

(54) GLOVE AND WRITING UTENSIL COMBINATION

(76) Inventor: Gladys F. Materon, 97-10 62 Dr., Apartment #8J, Rego Park, NY (US) 11374

( * ) Notice: Subject to any disclaimer, the term of this patent is extended or adjusted under 35 U.S.C. 154(b) by 0 days.

(21) Appl. No.: 10/190,063

(22) Filed: Jul. 8, 2002

(51) Int. Cl.[7] ..... A41D 19/00
(52) U.S. Cl. ..... 2/160; 2/163
(58) Field of Search ..... 2/160, 161.1, 161.3, 2/161.5, 161.6, 163; 401/48

(56) References Cited

U.S. PATENT DOCUMENTS 3,128,514 A * 4/1964 Parker et al. ..... 2/300
3,787,898 A * 1/1974 Walker ..... 2/163
4,447,912 A * 5/1984 Morrow ..... 2/159
4,602,885 A * 7/1986 Bischoff et al. ..... 24/11 F
5,557,805 A * 9/1996 Emerson ..... 2/158
5,853,210 A * 12/1998 Robinson ..... 2/160
6,397,394 B1 * 6/2002 Hambly ..... 2/160

* cited by examiner

*Primary Examiner*—John J. Calvert
*Assistant Examiner*—Katherine Moran

(57) ABSTRACT

A glove and writing utensil combination for aiding in the holding of a writing utensil and includes a glove having a palm portion, a back portion, a plurality of finger portions and a thumb portion. The finger portions include a first through fourth finger portions. The first finger portion is positioned adjacent to the thumb portion. The glove has a wrist opening extending therein for receiving a hand. A first attaching member is coupled to the first finger. A writing utensil is provided having a second attaching member attached thereto. The first and second attaching members may selectively attach the writing utensil to the first finger portion.

7 Claims, 3 Drawing Sheets

GLOVE AND WRITING UTENSIL COMBINATION

BACKGROUND OF THE INVENTION

1. Field of the Invention

The present invention relates to gloves with attaching means and more particularly pertains to a new glove with attaching means for aiding a person in gripping an object.

2. Description of the Prior Art

The use of gloves having attachment means thereon for gripping objects is known in the prior art. U.S. Pat. No. 5,943,701 describes a device for attaching an aerosol can to a glove for protective purposes. Another type of glove for gripping objects is U.S. Pat. No. 6,000,058 having a glove and a sleeve for positioning on a can so that the can is held to the hand by the sleeve and glove combination.

While these devices fulfill their respective, particular objectives and requirements, the need remains for a device that aids handicapped or otherwise impaired persons in the holding of a writing utensil.

SUMMARY OF THE INVENTION

The present invention meets the needs presented above by including a glove and writing utensil each having an attaching means thereon so that the glove aids in the holding of the writing utensil.

Still yet another object of the present invention is to provide a new glove having a plurality of attaching members thereon for gripping to a utensil in a plurality of positions.

To this end, the present invention generally comprises a glove having a palm portion, a back portion, a plurality of finger portions and a thumb portion. The finger portions include a first through fourth finger portions. The first finger portion is positioned adjacent to the thumb portion. The glove has a wrist opening extending therein for receiving a hand. A first attaching member is coupled to the first finger. A writing utensil is provided having a second attaching member attached thereto. The writing utensil may be selectively attached to the first finger portion by the first and second attaching members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
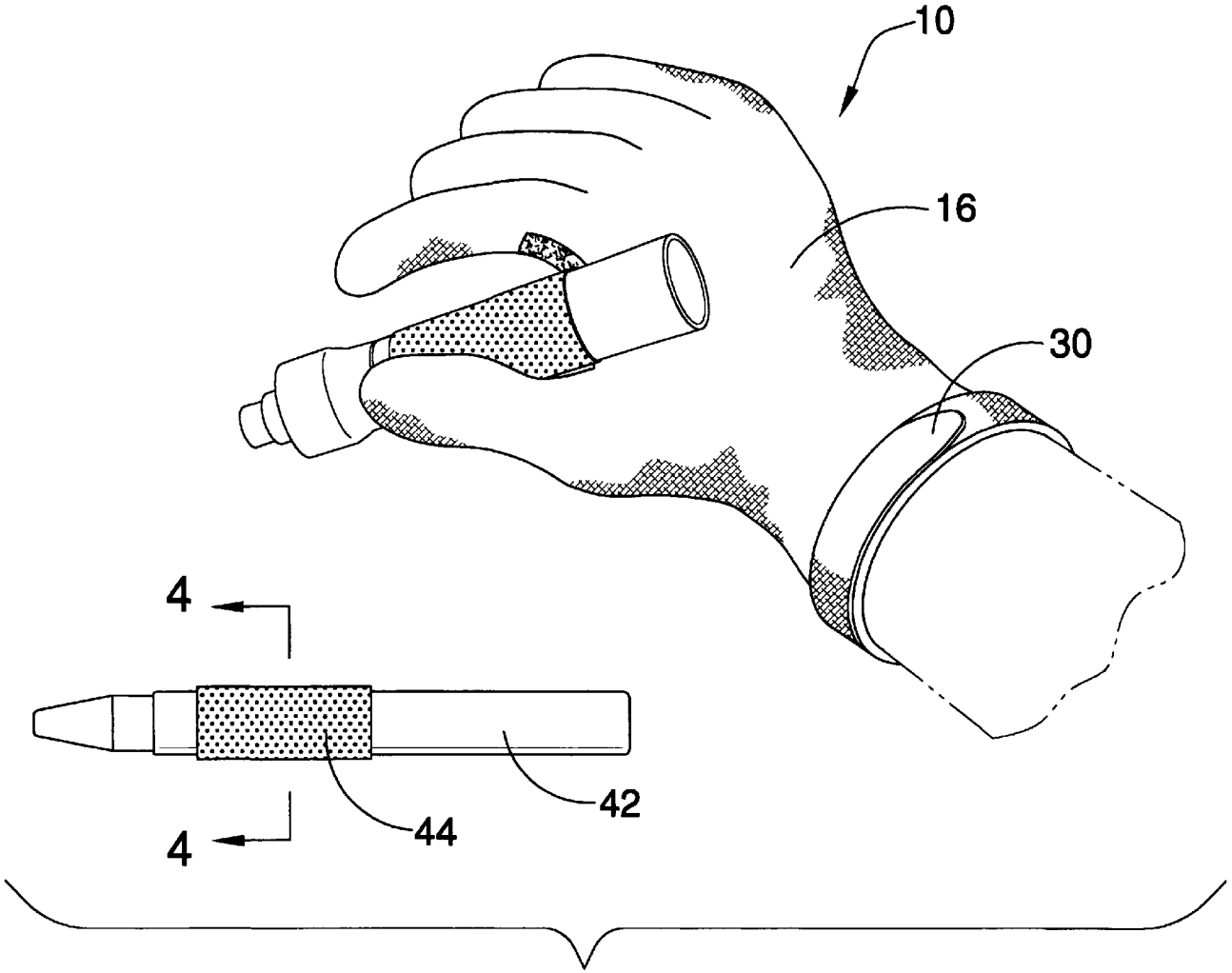
FIG. 1 is a schematic perspective view of a glove and writing utensil combination according to the present invention.
Figure 2:
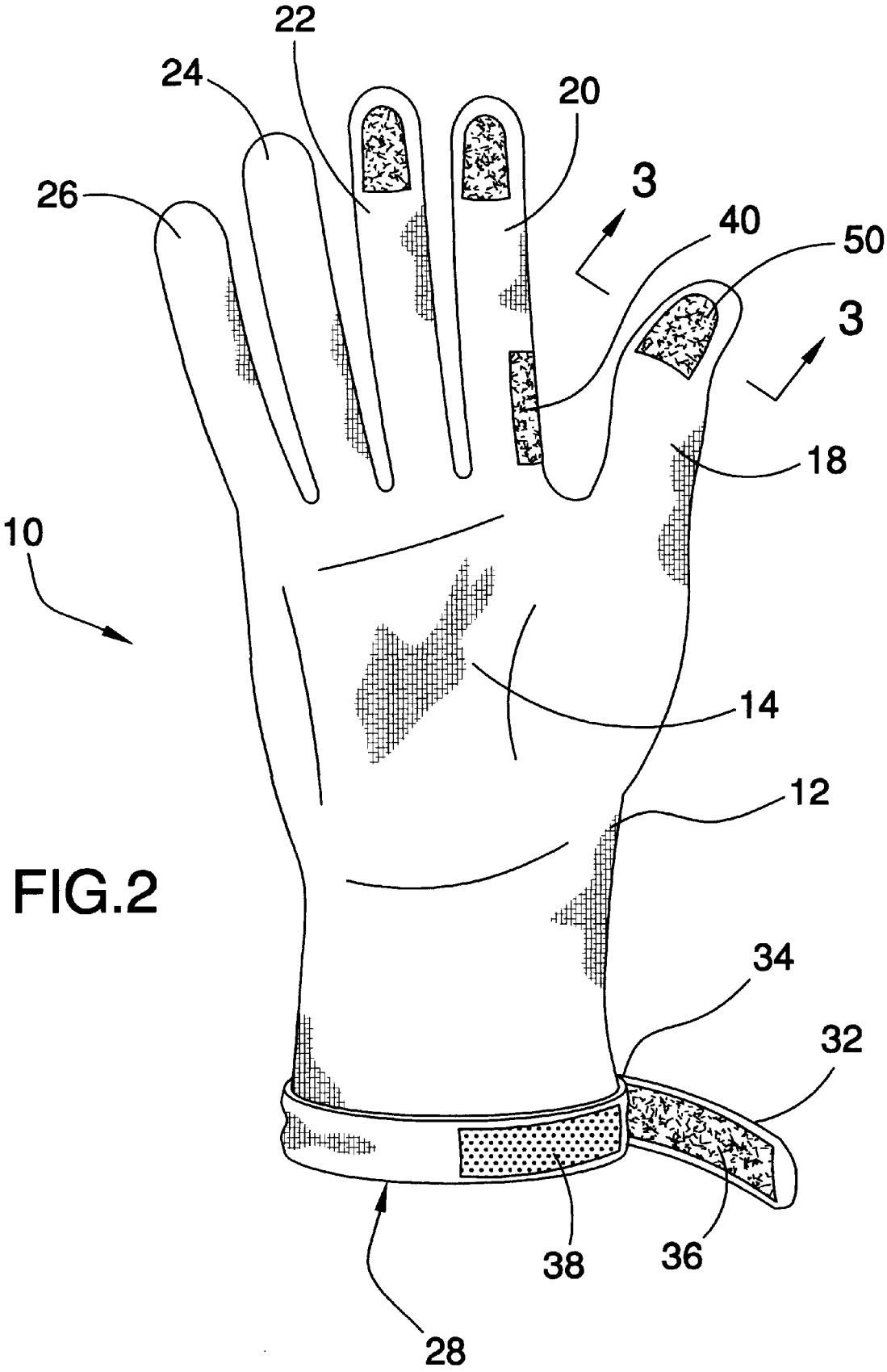
FIG. 2 is a schematic front view of the glove the present invention.
Figure 3:
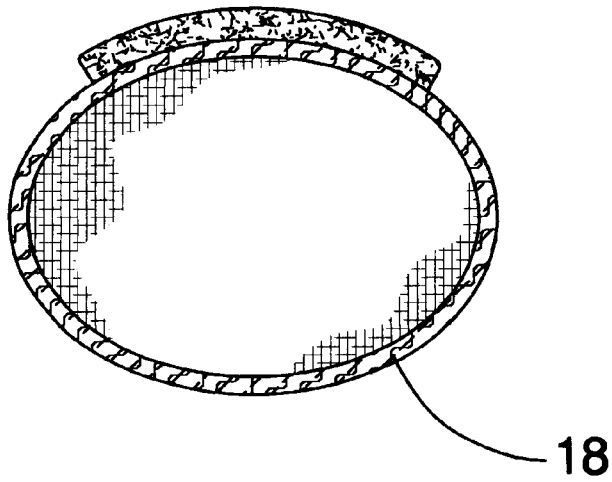
FIG. 3 is a schematic cross-sectional view taken along line 3—3 of FIG. 2 of the present invention.
Figure 4:
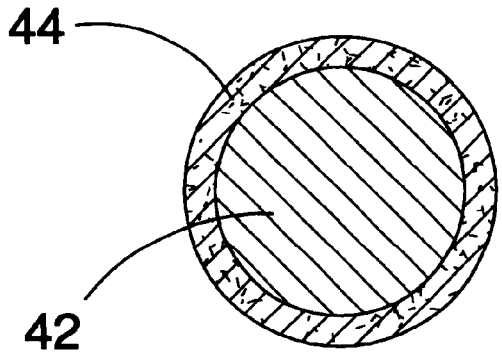
FIG. 4 is a schematic cross-sectional view taken along line 4—4 of FIG. 1 of the present invention.

With reference now to the drawings, and in particular to FIGS. 1 through 4 thereof, a new glove with attaching means embodying the principles and concepts of the present invention and generally designated by the reference numeral 10 will be described.

As best illustrated in FIGS. 1 through 4, glove and writing utensil combination 10 generally comprises a glove 12 having a palm portion 14, a back portion 16, a plurality of finger portions and a thumb portion 18. The finger portions include a first finger portion 20, a second finger portion 22, a third finger portion 24 and a fourth finger portion 26. The first finger portion 20 is positioned adjacent to the thumb portion 18. The glove 12 has a wrist opening 28 extending therein for receiving a hand.

A coupling member 30 for removably coupling the glove 12 to the hand is attached to the glove 12. The coupling member 30 is positioned on an outer surface of the glove 12 generally adjacent to the wrist opening 28. The coupling member 30 includes a strap 32 having a first end 34 attached to the glove 12. A first coupling means 36 is attached to the strap 32. A second coupling means 38 is attached to an edge of the wrist opening 28. The first coupling means 36 is removably attachable to the second coupling means 38 and preferable comprises a hook and loop coupling means.

A first attaching member 40 is coupled to the first finger 20 and is positioned generally adjacent to and between the palm 14 and back 16 portions. The first attaching member 40 generally faces the thumb portion 18.

A writing utensil 42 has a second attaching member 44 attached thereto. The writing utensil 42 may be any common writing utensil 42 including but not limited to pens, pencils, markers and the like.

A third attaching member 46 is attached to the first finger portion 20 positioned near a free end of the first finger portion 20 and is located on a palm side 14 of the first finger portion 20. A fourth attaching member 48 is attached to the second finger portion 22 positioned near a free end of the second finger portion 22 and is located on a palm side 14 of the second finger portion 22. A fifth attaching member 50 is attached to the thumb portion 18 positioned near a free end of the thumb portion 18 and located on a palm side 14 of the thumb portion 18. Preferably the first through fifth attaching members 40, 44, 46, 48 and 50 includes a hook and loop attaching means such that the writing utensil 42 may be selectively attached to the first 20 and second 22 finger portions and the thumb portion 18.

In use, a user places the glove 12 on their hand and uses the coupling means 30 to secure the glove 12 on the hand. The user uses the attaching members to hold the writing utensil 42 to the glove and thereby circumvent lack of finger strength or control in order to use the writing utensil.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A glove and writing utensil combination device comprising:

a glove having a palm portion, a back portion, a plurality of finger portions and a thumb portion, said finger portions including a first through fourth finger portions, said first finger portion being positioned adjacent to said thumb portion, said glove having a wrist opening extending therein for receiving a hand;

a first attaching member being coupled to said first finger portion, said first attaching member being positioned generally adjacent to and between said palm and back portions, said first attaching member generally facing said thumb portion;

a writing utensil;

a second attaching member being attached to said writing utensil; and wherein said writing utensil may be selectively attached to said first finger portion by said first and second attaching members.

2. The glove and writing utensil combination device as in claim 1, further including a coupling member for removably coupling said glove to the hand being attached to said glove.

3. The glove and writing utensil combination device as in claim 2, wherein said coupling member is positioned on an outer surface of said glove generally adjacent to said wrist opening, said coupling member including a strap having a first end attached to said glove, a first coupling means being attached to said strap, a second coupling means being attached to an edge of said wrist opening, wherein said first coupling means is removably attachable to said second coupling means.

4. The glove and writing utensil combination device as in claim 1, further including a third attaching member being attached to said first finger portion and positioned near a free end of said first finger portion and located on a palm side of said first finger portion.

5. glove and writing utensil combination device as in claim 4, further including a fourth attaching member being attached to said second finger portion and positioned near a free end of said second finger portion and located on a palm side of said second finger portion.

6. The glove and writing utensil combination device as in claim 5 further including a fifth attaching member being attached to said thumb portion and positioned near a free end of said thumb portion and located on a palm side of said thumb portion.

7. A glove and writing utensil combination device comprising:

a glove having a palm portion, a back portion, a plurality of finger portions and a thumb portion, said finger portions including a first through fourth finger portions, said first finger portion being positioned adjacent to said thumb portion, said glove having a wrist opening extending therein for receiving a hand;

a coupling member for removably coupling said glove to the hand being attached to said glove, said coupling member being on an outer surface of said glove generally adjacent to said wrist opening, said coupling member including a strap having a first end attached to said glove, a first coupling means being attached to said strap, a second coupling means being attached to an edge of said wrist opening, wherein said first coupling means is removably attachable to said second coupling means;

a first attaching member being coupled to said first finger portion and being positioned generally adjacent to and between said palm and back portions, said first attaching member generally facing said thumb portion;

a writing utensil;

a second attaching member being attached to said writing utensil;

a third attaching member being attached to said first finger portion and positioned near a free end of said first finger portion and located on a palm side of said first finger portion;

a fourth attaching member being attached to said second finger portion and positioned near a free end of said second finger portion and located on a palm side of said second finger portion;

a fifth attaching member being attached to said thumb portion and positioned near a free end of said thumb portion and located on a palm side of said thumb portion; and wherein said first through fifth attaching members includes a hook and loop attaching means such that said writing utensil may be selectively attached to said first and second finger portions and the thumb portion.

* * * * *